United States Patent [19]

Heinrich

[11] 4,192,475

[45] Mar. 11, 1980

[54] METHOD AND DEVICE FOR STOPPING OUT INTERFERING RADIATORS IN AN OPTICAL MISSILE-STEERING DEVICE

[75] Inventor: Wilhelm Heinrich, Munich, Fed. Rep. of Germany

[73] Assignee: Messerschmitt-Bölkow-Blohm GmbH, Fed. Rep. of Germany

[21] Appl. No.: 858,428

[22] Filed: Dec. 7, 1977

[30] Foreign Application Priority Data

Dec. 7, 1976 [DE] Fed. Rep. of Germany ..... 2655306

[51] Int. Cl.[2] ..... F41C 9/00; F41C 3/00

[52] U.S. Cl. ..... 244/3.16

[58] Field of Search ..... 244/3.16; 358/113

[56] References Cited

U.S. PATENT DOCUMENTS

| | | | |
|---|---|---|---|
| 2,955,777 | 10/1960 | Null et al. | 244/3.16 |
| 2,989,640 | 6/1961 | Turck | 244/3.16 |
| 3,053,984 | 9/1962 | Hulett | 244/3.16 |
| 3,107,070 | 10/1963 | Willits et al. | 244/3.16 |
| 3,239,674 | 3/1966 | Aroyan | 244/3.16 |
| 3,638,025 | 1/1972 | Dishington et al. | 358/113 |

*Primary Examiner*—Stephen C. Bentley
*Assistant Examiner*—Thomas H. Webb
*Attorney, Agent, or Firm*—McGlew and Tuttle

[57] ABSTRACT

A method of stopping out interfering radiators in a device for optically viewing the radiation produced by a missile through a lens aperture and for steering the missile as a result of the radiation viewed, comprising setting the opening of the lens aperture in a wide opening position during the launch of the missile and viewing the radiation through the opening set, determining the off position of the missile relative to the optical axis of the device by means of a modulator disc disposed in the image plane of the device and a radiation detector which is disposed behind the image plane on which the image of the entrance pupil of the device is formed and, after the off position is determined, reducing the image field of the lens of the device to an image area immediately surrounding the missile. The device for carrying out the method advantageously includes an aperture stop which is disposed in the image plane of the device for optically steering the missile which includes an aperture or an aperture stop within the image plane which is adjustable. The detector is arranged in the image plane and it gives a signal to an evaluator unit which also receives a reference signal which is separately generated to the desired amount and fed into the evaluation unit. The evaluation unit in turn issues a signal which may be used for a steering control as well as a control for operating an actuator for adjusting the lens system or opening.

6 Claims, 1 Drawing Figure

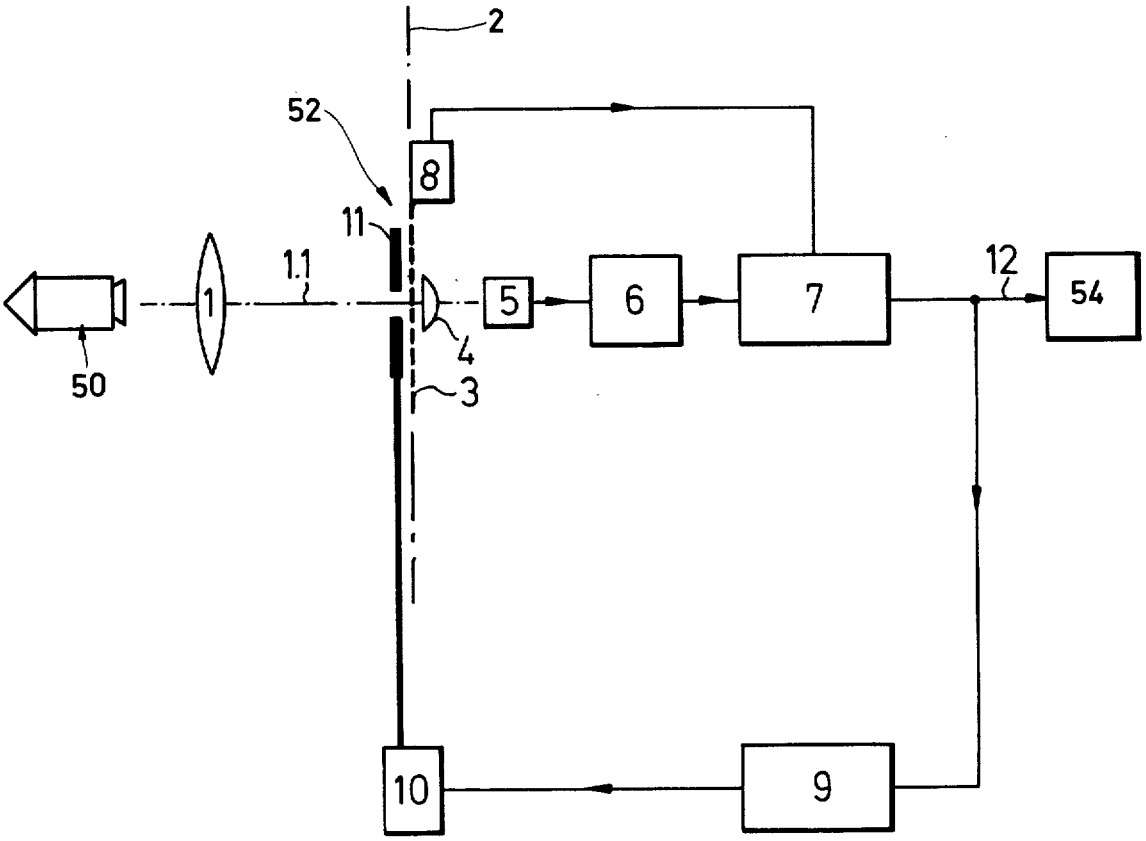
2
52
8
11
1.1
1
5
6
7
12
54
4
50
3
10
9

METHOD AND DEVICE FOR STOPPING OUT INTERFERING RADIATORS IN AN OPTICAL MISSILE-STEERING DEVICE

FIELD AND BACKGROUND OF THE INVENTION

This invention relates to guided missiles in general and, in particular, to a new and useful method and device for stopping out interfering radiators in an optical missile-steering device, in which the off position of the missile relative to the optical axis of the device is determined by means of a modulator disc disposed in the image plane of the device and of a radiation detector which is disposed behind the image plane and on which the image of the entrance pupil of the device is formed.

DESCRIPTION OF THE PRIOR ART

In optical missile-steering devices, the field of vision of the device is associated, through an objective, with an image field in the image plane. A modulator disc is provided in this image plane by which the radiation coming from the field of vision is modulated. A collective optical system is provided behind the modulator disc, by which the modulated radiation is focused on a detector. The electrical output signals of the detector are delivered through an amplifier to an electronic evaluation circuit.

With a missile within the field of vision of the device and with the power radiated by the missile sufficiently contrasting with the other radiations coming from the field of vision, a modulated signal appears at the output of the detector, from which, by means of the electronic evaluation circuit and a reference signal produced by a reference-signal generator provided at the modulator disc, the angular off position of the missile relative to the optical axis of the device is determined. The corresponding off-position signals are used for steering the missile.

In many instances, aside from the radiation of the missile, radiation from other sectors of the field of vision also falls on the entrance lens, for example, from the sun, whereby, the determination of the angular off position of the missile is disturbed. A device is known from German Pat. No. 976,222, which comprises optical systems of locating and sighting mechanism and stopping out sun rays and which includes a diaphragm for screening the sun which is disposed in the optical system in an intermediate image plane and is caused to follow the movement of the sun image by a control circuit known per se. However, this device is ineffective against a single or a plurality of interfering radiators of similar magnitude and intensity as the radiation source of the missile. In such cases, the steering mechanisms, depending on the modulation and evaluation process, determines and follows either the most powerful radiator within the field of vision, or the thermal center of gravity of all of the radiators within this field, or any other value.

SUMMARY OF THE INVENTION

The present invention is directed to a method and device which largely eliminates the influence of interfering radiators of any kind. In accordance with the invention, it is provided that after the launch of the missile, the image field of the device is reduced to an image area immediately surrounding the missile.

The invention starts from the following knowledge.

With the missile launched in the immediate vicinity of the optical missile-steering device, up to a certain distance covered by the missile, the radiated power delivered by the missile or its radiation source and reaching the objective is substantially greater than that incident from any other radiation source. Consequently, during this period of time, the device reliably determines the angular off position of the missile. Now, in accordance with the invention, for the further period of flight, the influence of interfering radiators can be eliminated by reducing the image field of the device to an image area immediately surrounding the missile.

According to a development of the invention, the diameter of the image area surrounding the missile is adjusted as a function of the flight time or of the distance of the missile from the steering device.

Advantageously, the position of an aperture stop provided in the image plane of the device may also be adjusted, as a function of the off position of the missile relative to the optical axis of the device.

Thus, at the launch of the missile, the aperture stop is opened so far that the radiation from the entire field of vision passes to the detector. As soon as the optical steering device has located the missile at a short distance and has determined the off position thereof relative to the optical axis, a control mechanism using, for example, the output signal of the device moves the center of the aperture stop to the location of the image field where the image of the missile is formed. Simultaneously, the diameter of the aperture is reduced to a small value, so that the detector receives only the radiation from an image field comprising the missile and the immediate vicinity thereof.

The value to which the diameter of the aperture can be reduced depends on the accuracy of the output signals of the device, the constant-field suppression of the modulator disc, the maneuvering capability of the missile and on outside influences, such as the directional movements of the device. During the entire flight of the missile, the image area surrounding the missile is automatically readjusted under the control of the output signals of the device.

Once the off position of the missile is determined, the diameter of the aperture may be instantly reduced to its minimum possible value which is then maintained during the entire remaining flight time. It is also possible, however, to reduce the diameter continuously, as a function of the missile distance or the elapse of flight time, for example, by means of a control program.

In cases where the missile is automatically steered to the optical axis of the device, there is no need for controlling the position of the aperture within the image plane. What remains is to reduce the diameter of the aperture in accordance with the trajectory.

Accordingly, it is an object of the invention to provide a method of stopping out interfering radiators in a device for optically viewing the radiation of a missile through a lens aperture and for steering the missile as a result of the radiation sensed, which comprises setting the opening of the aperture so far that the radiation from the entire field of vision passes through a detector for viewing the device through the opening set, determining the off position of the missile relative to the optical axis of the device by means of a modulator disc disposed in the image plane of the device and the radiation detector which is disposed behind the image plane and on which the image of the entrance pupil of the device is formed, and after the off position is determined, reducing the image field of the optical system of the device to an image area immediately surrounding the missile.

A further object of the invention is to provide a device for tracking a missile for the purpose of optically steering it which comprises a radiation detector, an evaluation unit connected to the detector and a lens system for focusing the detected radiation on said detector and including an adjustable aperture, and further including modulator means for modulating the light passed to the detector through the aperture and means for imparting a reference signal to said evaluator to provide an off position detection, said evaluator providing an off position signal, and means operative by said off position signal for controlling at least one of said lens and said missile.

A further object of the invention is to provide a device for tracking a missile for the purpose of optically steering it which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a schematic illustration of a device for tracking a missile for the purpose of optically steering the same, constructed in accordance with the invention.

DESCRIPTION OF THE PREFERRED EMBODIMENT

The radiation emitted by a launched missile 50 is received through an objective 1 of an optical missile-steering device and radiation detector, generally designated 52. The radiation is modulated by a modulator disc 3 disposed in the image plane 2 and allowed to pass, through a collective optical system 4, to a detector 5. To obtain a high angular resolution and a high sensitivity to radiation of the device, it is advantageous to provide a maximum possible size of the image corresponding to the field of vision and, thereby, of modulator disc 3, and a minimum possible radiation-responsive area of detector 5.

The signals received by detector 5 are amplified in an amplifier 6 and transmitted to an electronic evaluation unit 7. From the signals received and from a reference signal which is produced by a reference signal generator 8 connected to the modulator disc 3, evaluation unit 7 determines the off position of the missile relative to the optical axis 1.1 of the device.

The off-position signal is furnished through a line 12 to a steering control 54 for steering the missile and is also supplied to a control unit 9 which is connected to an actuator 10 for adjusting an aperture stop 11 which is disposed in the image plane 2. Actuator 10 adjusts the diameter and position of aperture 11 within image plane 2, in accordance with the determined off-position signals of the missile, so that the image field is narrowed to an image area immediately surrounding the missile.

In accordance with the method of the invention, a device for optically viewing the radiation from the missile 50 is arranged to pass an optical view of the radiation to the detector 5 and to amplify the radiation viewed and indicate the information in the evaluation unit 7. The reference signal which is generated by the reference device 8 is such that it will provide an indication to the evaluation unit 7 of the off position in which the radiation axis is not centered in respect to the aperture of the lens system.

While a specific embodiment of the invention has been shown and described in detail to illustrate the application of the principles of the invention, it will be understood that the invention may be embodied otherwise without departing from such principles.

What is claimed is:

1. A method of stopping out interfering radiators in a device for optically viewing the radiation of a missile through a lens aperture which includes an image field, and detector for viewing the radiation which is aligned with the lens axis and for steering the missile, comprising directing the radiation to a spot within the image field of the lens system and continuously directing the optical axis of the lens system to a target, disposing a modulator disc in association with the lens system and ahead of the radiation detector so that the radiation is viewed by the detector, determining the off position of the missile relative to the optical axis of the lens system, and after the missile is launched and after the off position is determined, setting an aperture stop reducing the image field of the lens system to an image area immediately surrounding the missile.

2. A method as claimed in claim 1, wherein an evaluation unit is connected to the detector to sense a radiation signal in respect to the radiation received by it and a reference signal is transmitted to the evaluation unit for aiding in determining an off position so that the evaluation unit produces an off position signal and adjusting the opening of the lens system as a function of the flight time for the distance of the missile from the device.

3. A method as claimed in claim 1, wherein the position of the opening stop disposed in the image plane of the device is adjusted as a function of the off position of the missile relative to the optical axis of the device.

4. A method as claimed in claim 1, wherein the evaluation unit produces an off position signal and the off position signal is used for steering the missile.

5. A method as claimed in claim 1, wherein the evaluation unit produces an off position signal which is used for the controlling of the opening of the aperture of the system.

6. A device for tracking a missile for the purpose of optically steering it, comprising a radiation detector, an evaluation unit connected to said detector, a lens system having a lens for focusing the detected radiation on said detector arranged in front of said detector and including an adjustable aperture, said lens having an optical axis, and means for projecting the optical axis at the target, modulator means disposed between said aperture and said detector for modulating the radiation passed to said detector, means for imparting a reference signal to the evaluation unit to provide an off position detection from the signal received by said evaluation unit from said detector, said evaluation unit providing an off signal, and means connected to said evaluation unit for receiving said off signal and operated by said off signal for control of at least one of said lens and said missile.

* * * * *